United States Patent [19]

Stahlecker et al.

[11] Patent Number: 4,768,337

[45] Date of Patent: Sep. 6, 1988

[54] PROCESS AND ARRANGEMENT FOR PRODUCING FEED SPOOLS FOR A TWISTING OPERATION

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 105,566

[22] Filed: Oct. 8, 1987

[30] Foreign Application Priority Data

Nov. 28, 1986 [DE] Fed. Rep. of Germany ..... 3640775

[51] Int. Cl.[4] ..... D01H 5/28; D02G 3/26; D02G 3/38

[52] U.S. Cl. ..... 57/328; 57/3; 57/5; 57/6; 57/350

[58] Field of Search ..... 57/3, 5, 6, 328, 333, 57/350

[56] References Cited

U.S. PATENT DOCUMENTS 4,055,039 10/1977 Movshovich et al. ..... 57/333 X
4,206,589 6/1980 Markey et al. ..... 57/350 X
4,484,436 11/1984 Nakayama et al. ..... 57/328

FOREIGN PATENT DOCUMENTS 0038143 10/1981 European Pat. Off. .
0070210 1/1983 European Pat. Off. .

*Primary Examiner*—John Petrakes
*Attorney, Agent, or Firm*—Barnes & Thornburg

[57] ABSTRACT

In the case of a process for producing feed spools for a twisting operation that comprises essentially two slivers that are prestrengthened by pneumatic false twisting, it is provided that after the pneumatic false twisting and before the winding-up, a filament yarn is added.

13 Claims, 1 Drawing Sheet

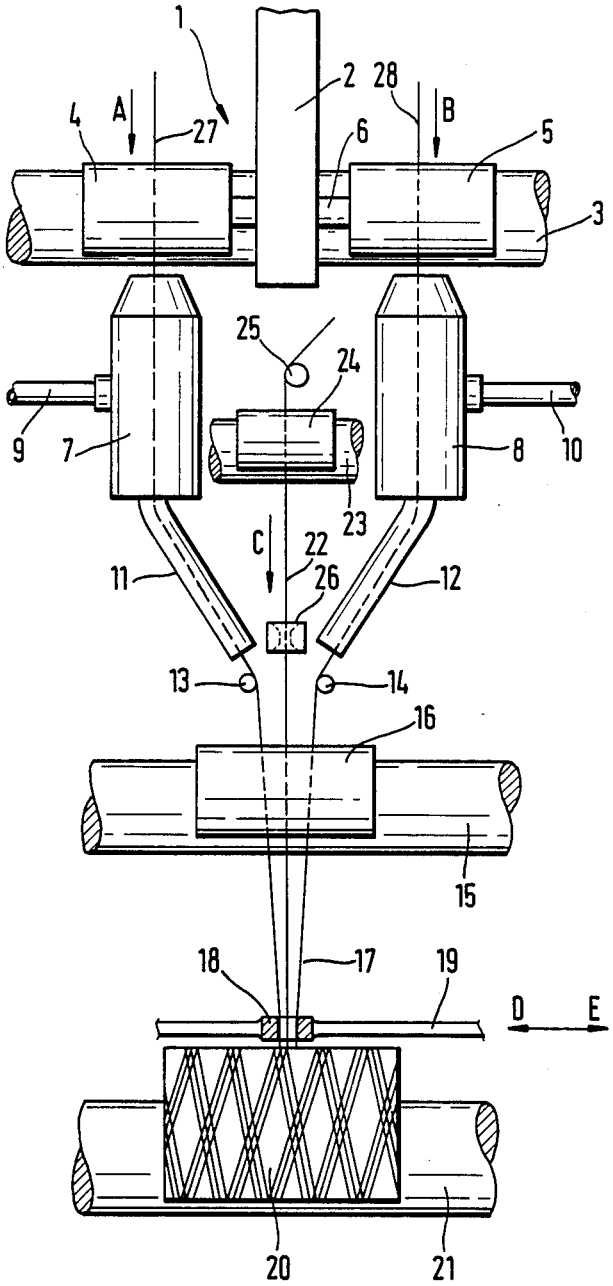
1
2
28
A
B
4
27
6
5
3
25
24
9
7
8
10
23
C
22
26
11
12
13
14
16
15
18
17
19
D
E
20
21

PROCESS AND ARRANGEMENT FOR PRODUCING FEED SPOOLS FOR A TWISTING OPERATION

BACKGROUND AND SUMMARY OF THE INVENTION

The invention relates to a process for producing feed spools for a twisting operation in which two slivers are first drafted, are then prestrengthened by means of pneumatic false-twisting and are then wound onto feed spools while they are located next to one another, as well as to an arrangement for producing such wound feed spools.

By means of the known processes and arrangements of the initially mentioned type (See European Patent Applications EP-A Nos. 38 143, 70 210), a significant increase in production can be achieved because the slivers are first prestrengthened only by the pneumatic false-twisting without reaching a strength that will make them suitable for a further processing as a single yarn. The final strength is obtained only by means of a subsequent twisting operation. However, the yarns that are only prestrengthened, particularly in the area behind the devices for pneumatic false-twisting, are subjected to considerable stress, so that yarn breakages occur frequently. It is therefore known to reinforce the slivers by means of filament yarn. For this purpose, a filament yarn is added to each of these slivers at the pair of delivery rollers of the pertaining drafting frame. Filament yarn of this type, however, is relatively expensive so that at least some of the advantages that are obtained by the simplified spinning and twisting process are eliminated again.

An objective of the invention is to provide a process and arrangement which minimizes the occurrence of yarn breakages with less expenditures.

This objective is achieved by adding a filament yarn after the pneumatic false-twisting and before the winding-up of the false twisted yarn.

In the case of the invention, only one filament yarn is required. In this case, the invention is based on the recognition that the false twist that is applied during the pneumatic false twisting acts as a protecting twist until the drafting frame is reached so that in this area the danger of a yarn breakage is relatively low. The critical range will therefore be behind the devices for the pneumatic false twisting, because the false twist opens up and only the prestrengthening is in effect that is produced by a residual winding-around of the edge fibers. According to the recognition of the invention, it is therefore sufficient to add the filament yarn not before this point at which the two yarn components are guided together so that the prestrengthened slivers and the filament yarn jointly pass through the withdrawal device and the wind-up device. The filament yarn therefore offers an improved protection against yarn breakages particularly in the area of the wind-up device in which, because of the side traverse motion, the stress to the yarn is increased.

In a further development of preferred embodiments of the invention, it is provided that the filament yarn is fed between the slivers that, during the winding-up, embed the filament yarn between themselves. During the subsequent twisting-together, a new type of core twist yarn is obtained.

In a further development of preferred embodiments of the invention, it is provided that the filament yarn is fed under a defined, preferably adjustable, tension. As a result, it is possible to coordinate the filament yarn, with respect to the feeding, with the prestrengthened slivers leaving the false-twisting devices.

Other objects, advantages and novel features of the present invention will become apparent from the following detailed description of the invention when considered in conjunction with the accompanying drawing.

BRIEF DESCRIPTION OF THE DRAWING

The single drawing FIGURE is a schematic view of a single spinning unit of a multi-unit spinning machine, constructed in accordance with preferred embodiments of the invention.

DETAILED DESCRIPTION OF THE DRAWING

A drafting frame 1 is assigned to each spinning unit. Only the area of the pair of delivery rollers 3, 4; 3, 5 of the drafting frame 1 is shown in the drawing. The drafting frame 1 comprises several driven bottom rollers that extend through in the longitudinal direction of the machine, of which only bottom roller 3 is shown in the drawing. To these bottom rollers, twin pressure rollers are assigned that are arranged on a supporting and weighting arm 2, of which that pressure roller twin is shown that has a shaft 6 and the two pressure rollers 4 and 5.

In the drafting frame 1, two fed slivers 27, 28 are drawn to the desired yarn size. Then the slivers 27, 28 pass through a pneumatic false-twisting element 7, 8 that in each case directly follows the pairs of delivery rollers 3, 4; 3, 5. These pneumatic false-twisting elements 7, 8, that are connected to the compressed-air feeding lines 9, 10, are shown only in diagram form. In practice, they include at least two air nozzles that are arranged behind one another, of which the first air nozzle that connects directlY to the pairs of delivery rollers 3, 4; 3, 5 of the drafting frame 1 is a suction nozzle, while the air nozzle that follows is the false-twisting nozzle.

The slivers 27, 28 that leave the pneumatic false-twisting devices 7, 8 are prestrengthened by the false twisting. In this case, the false-twisting takes place to such an extent that a certain number of edge fibers located on the outside is wound around the filters that are located further on the inside. This winding-around is maintained, even when the false twist opens up again behind the pneumatic false-twisting devices 7, 8.

The prestrengthened slivers 27, 28 are taken over by means of guiding tubes 11, 12 and are guided diagonally toward one another. At the end of the guiding tubes 11, 12, yarn guides 13, 14 are located that are arranged at a small spacing from one another. Behind the yarn guides 13, 14, the two prestrengthened slivers 27, 28 are taken over by a withdrawal device that includes a driven bottom roller 15 that extends through in the longitudinal direction of the machine and of a pressure roller 16. The prestrengthened slivers 27, 28 that were guided together but are still moving along at a slight spacing next to one another are then wound onto a cross-wound spool 20 in a multiple-wound way. The cross-wound spool which is held by a known spool-holding device in a way that is not shown in detail, is driven by a winding roller 21 that extends through in the longitudinal direction of the machine. The prestrengthened slivers 27, 28 pass through a cross-winding yarn guide 18 that is arranged on a cross-winding rod 19 that moves back and forth (in the direction of the arrows D and E) in the longitudinal direction of the machine.

In the area of the yarn guides 13, 14, a filament yarn 22 is fed as the reinforcing yarn between the two prestrengthened yarn components in the direction of the arrow C. The filament yarn 22, via a yarn guide 26, moves between the two yarn quides 13, 14 and thus between the two prestrengthened slivers 27, 28 into the withdrawal device 15, 16. Then the prestrengthened slivers 27, 28 and the filament yarn 22 are fed to the cross-winding yarn guide 18 as a triple yarn 17. This triple yarn 17 is then wound onto the spool 20 that is used as the feed spool for a twisting process and that is processed, for example, on a double-twist frame.

In front of the yarn guide 26 of the filament yarn 22, a yarn brake is connected that is formed of a pair of delivery rollers 23, 24 that, in turn, includes a driven bottom roller 23 extending through in the longitudinal direction of the machine and of a pressure roller 24. Because of this pair of delivery rollers 23, 24, it is possible to adjust the yarn tension of the filament yarn 22 in such a way that it is coordinated with the corresponding values of the prestrengthened slivers 27, 28.

By means of the feed spool 20 containing the triple yarn 17, a twist yarn can be obtained that has a character that is similar to that of a core twist yarn. The filament yarn 22 ensures that, particularly in the area of the withdrawal device 15, 16 and of the wind-up device 18, 21, yarn breakages can hardly occur anymore.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A process for producing feed spools for a subsequent twisting operation in which two slivers are first drawn, are then prestrengthened by means of pneumatic false-twisting and are then wound to the feed spool while they are located next to one another, wherein a filament yarn is added to the silvers after the pneumatic false twisting of the silvers and before the winding-up of the prestrengthened silvers together with the filamnet yarn.

2. A process according to claim 1, wherin the filament yarn is fed between the prestrengthened silvers that embed the filament yarn between themselves during the winding-up.

3. A process according to claim 2, wherein the filament yarn is fed under a defined, preferably adjustable tension.

4. A process according to claim 1, wherein the filament yarn is fed under a defined, preferably adjustable tension.

5. An arrangement for producing feed spools of prestrengthened silvers for use in subsequent twisting operations, comprising:

a pair of pneumatic false twisting devices for supplying a pair of adjacently running prestrengthened silvers;

spool wind up means for winding up the pair of prestrengthened slivers adjacent one another; and filament yarn feeding means disposed downstream of the pneumatic false twisting devices and including means for feedng filament yarn to the prestrengthened slivers between the pneumatic false twisting devices and the spool wind up means, whereby the pair of prestrengthened slivers and the filament yarn are together wound up adjacent one another on feed spools by the spool wind up means.

6. An arrangement according to claim 5, wherein a pair of drafting frame means are provided for supplying drafted sliver to the respective pneumatic false twisting devices.

7. An arrangement according to claim 5, wherein the filament yarn feeding means are arranged in front of a withdrawal device through which the two prestrengthened slivers and the filament yarn pass jointly.

8. An arrangement according to claim 7, wherein the filament yarn feeding means are arranged between devices for the guiding-together of the prestrengthened slivers.

9. An arrangement according to claim 7, wherein the filament yarn feeding means contains a yarn brake.

10. An arrangement according to claim 9, wherein the yarn brake is developed as a pair of delivery rollers.

11. An arrangement according to claim 5, wherein the filament yarn feeding means are arranged between devices for the guiding-together of the prestrengthened slivers.

12. An arrangement according to claim 5, wherein the filament yarn feeding means contains a yarn brake.

13. An arrangement according to claim 12, wherein the yarn brake is developed as a pair of delivery rollers.

* * * * *